US006705021B2

(12) United States Patent
Nadal et al.

(10) Patent No.: US 6,705,021 B2
(45) Date of Patent: Mar. 16, 2004

(54) LAP SIDING INSTALLATION TOOL

(75) Inventors: Mark J. Nadal, Portland, OR (US); Kary P. Tiel, Portland, OR (US); David D. Hendricks, Portland, OR (US)

(73) Assignee: Inventioneering, Inc., Portland, OR (US)

( * ) Notice: Subject to any disclaimer, the term of this patent is extended or adjusted under 35 U.S.C. 154(b) by 0 days.

(21) Appl. No.: 09/910,449

(22) Filed: Jul. 19, 2001

(65) Prior Publication Data

US 2003/0014877 A1 Jan. 23, 2003

(51) Int. Cl.[7] ..... G01D 21/00
(52) U.S. Cl. ..... 33/647; 33/411; 33/649
(58) Field of Search ..... 33/646, 647, 648, 33/649, 411

(56) References Cited

U.S. PATENT DOCUMENTS

| | | | | | |
|---|---|---|---|---|---|
| 339,077 | A | * | 3/1886 | Snyder | 33/647 |
| 340,592 | A | * | 4/1886 | Montgomery et al. | 33/646 |
| 351,722 | A | * | 10/1886 | Trublood | 33/647 |
| 418,754 | A | * | 1/1890 | Schill | 33/646 |
| 494,214 | A | * | 3/1893 | Martin | 33/646 |
| 693,054 | A | * | 2/1902 | Nelson | 33/649 |
| 810,246 | A | * | 1/1906 | Anderson | 33/411 |
| 847,176 | A | * | 3/1907 | Good | 33/411 |
| 920,941 | A | * | 5/1909 | Fllkin | 33/647 |
| 1,229,356 | A | * | 6/1917 | Watkins | 33/411 |
| 1,514,916 | A | * | 11/1924 | Leatherman | 33/411 |
| 1,780,849 | A | * | 11/1930 | Spillman | 33/646 |
| 1,783,260 | A | * | 12/1930 | Reed | 33/646 |
| 1,796,227 | A | * | 3/1931 | Velling | 33/411 |
| 3,133,357 | A | * | 5/1964 | Gayan | 33/647 |
| 3,463,480 | A | * | 8/1969 | Edstrom | 33/646 |
| 3,490,152 | A | * | 1/1970 | Printz | 33/649 |
| 4,425,714 | A | | 1/1984 | Kelly, Jr. | |
| 4,473,100 | A | | 9/1984 | Wheeler | |
| 4,484,392 | A | | 11/1984 | DeFino et al. | |
| 4,899,459 | A | * | 2/1990 | Taggart | 33/646 |
| 5,203,090 | A | * | 4/1993 | Bouska et al. | 33/646 |
| 5,305,532 | A | * | 4/1994 | Johnson et al. | 33/647 |
| 5,319,909 | A | * | 6/1994 | Singleterry | 33/411 |
| 5,385,183 | A | * | 1/1995 | Ferranti | 33/411 |
| 5,408,757 | A | | 4/1995 | Lenz | |
| 5,465,499 | A | * | 11/1995 | LaPlante | 33/647 |
| 2002/0100181 | A1 | * | 8/2002 | Evans | 33/647 |

* cited by examiner

*Primary Examiner*—Diego Gutierrez
*Assistant Examiner*—Travis Reis
(74) *Attorney, Agent, or Firm*—Kolisch Hartwell, P.C.

(57) ABSTRACT

A tool that assists in installing lap siding. The tool includes a body having a handle and a pair of vertically spaced-apart seat assemblies that define a seat distance therebetween. The lower seat assembly is adapted to engage the lower portion of a previously installed siding piece, and the upper seat assembly is adapted to support the lower portion of a siding piece to be installed at the determined reveal distance relative to the previously installed siding piece. The reveal distance is at least substantially defined by the seat distance. In some embodiments, the tool enables two or more installers to with one hand properly hold and provide for level alignment of the piece of lap siding to be installed, while at the same time enabling the installers to mechanically fasten the same with the other hand. In some embodiments, the tool is adjustable to accommodate a range of reveal sizes.

25 Claims, 9 Drawing Sheets

LAP SIDING INSTALLATION TOOL

FIELD OF THE INVENTION

The present invention relates generally to lap siding, and more specifically to a tool for installing lap siding.

BACKGROUND OF THE INVENTION

Lap siding is a common type of siding for buildings. Lap siding refers generally to siding in which multiple pieces of siding are attached to the building in a partially overlapping fashion. More specifically, a first piece is attached at the lower extent of the face of the building to be sided and then additional pieces are attached above it, with each additional piece at least partially overlapping the piece below it. The distance from the bottom of a piece to the bottom of the piece above it is referred to as a "reveal." A reveal may also be defined as the height of the siding piece less the amount of overlap by the piece installed above it, or more simply, the vertical or generally vertical portion of each siding piece that is seen after installation is complete. Mechanical fastening of siding pieces to the face of a building is most commonly achieved through the use of a pneumatic nail gun or similar device that may be operated with one hand.

A challenge when installing lap siding is to create uniform and level reveals, while at the same time addressing the occasional need to intentionally vary reveal sizes by incremental units to correct for any number of construction variances, such as if the ends of a building vary slightly in height or a window has been installed out-of-level. Another challenge is the ability to hold a siding piece properly and firmly to prevent slippage during mechanical fastening. Further, siding installers face the constant challenge of having to carry and use many individual tools, such as a level, straight edge for marking lines, hammer, tape measure, etc., which tends to be cumbersome and hazardous, particularly when working on scaffolding.

One common installation method used to achieve the desired reveals described above is to manually mark lines at taped intervals at each end of a previously fastened siding piece. The next siding piece to be installed is then aligned visually and hand-held during mechanical fastening. A disadvantage of this method is the added installation time required to measure and mark lines for each siding piece. In addition, measurements and markings of lines, as well as visual alignment of siding pieces to said lines, can vary from person to person, from one end of the piece to the other, and from piece to piece, thus introducing cumulative errors of scale and human error resulting in non-uniform reveals and siding pieces installed out of level. Furthermore, this method requires the installer to hand-position and hold each piece of siding during mechanical fastening, which can result in inadvertent slippage or movement of the siding.

Another installation method is to use blocks of wood, cut to the desired reveal size, as spacers that two installers can hold at each end of a siding piece, with the bottom of the block aligned with the bottom of the previously fastened piece and the top of the block providing a surface upon which the next siding piece can sit during mechanical fastening. Disadvantages of this method are that individual blocks of wood can vary in length, are susceptible to shrinking and swelling due to differences in moisture content, and deform after repeated use due to the wearing of the edges of the seated siding on the top of the block, all of which contribute to the aforementioned cumulative errors. In addition, the use of blocks as spacers requires the visual alignment of the bottom of the block with the bottom of the previously fastened piece of siding, and further introduces human error, especially because different individuals will be visually aligning each side of the lap siding. Further, while providing a seat for a siding piece to be installed, this method does not prevent lateral movement (outward from the building face) of the siding and can easily result in vertical slippage relative to the previously installed piece of lap siding, thereby requiring two hands to hold the siding piece and block in place.

Existing tools and devices for installing lap siding are disclosed in U.S. Pat. Nos. 4,473,100, 4,484,392, 4,425,714 and 5,408,757, the disclosures of which are hereby incorporated by reference. However, the devices disclosed in such patents, while somewhat useful when employed by a single installer, consist of tools that are of substantially fixed structures and which have proven to be inconvenient for rapid and efficient use. The devices are relatively complex in structure, are difficult to remove once a siding piece is fastened, and have a tendency to break or damage the siding during removal. The present invention provides a tool that is relatively simple in design, does not remain fixed to the siding after fastening, and yet can be used for the rapid, accurate and convenient installation of lap siding by two or more installers.

SUMMARY OF THE INVENTION

The present invention provides a tool that assists in installing lap siding. The tool includes a body having a handle and a pair of vertically spaced-apart seat assemblies that define a seat distance therebetween. The lower seat assembly is adapted to engage the lower portion of a previously installed siding piece, and the upper seat assembly is adapted to support the lower portion of a siding piece to be installed at the determined reveal distance relative to the previously installed siding piece. The reveal distance is at least substantially defined by the seat distance. In some embodiments, the tool enables two or more installers to with one hand properly hold and provide for level alignment of the piece of lap siding to be installed, while at the same time enabling the installers to mechanically fasten the same with the other hand. In some embodiments, the tool is adjustable to accommodate a range of reveal sizes.

DETAILED DESCRIPTION AND BEST MODE OF THE INVENTION

Figure 1:
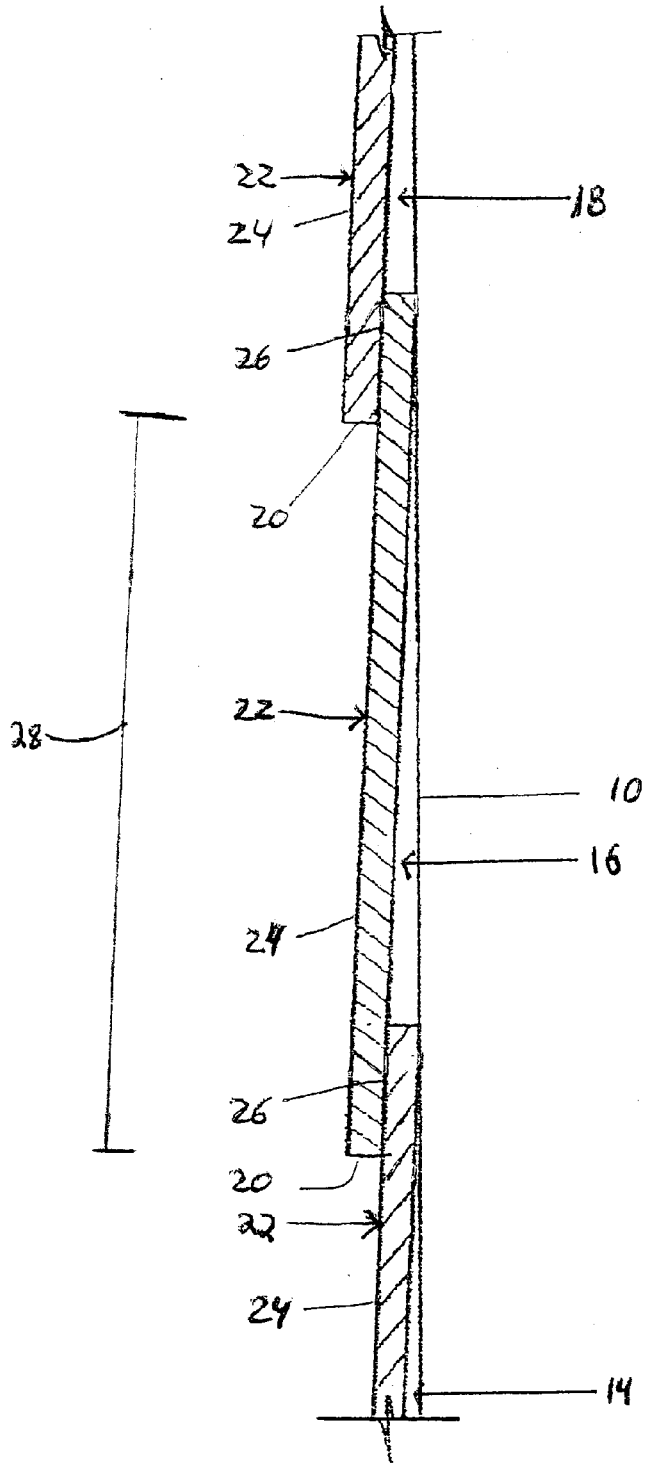
FIG. 1 is a fragmentary side elevation view of a portion of a face of a building with lap siding installed thereupon.

A portion of a face 10 of a building is shown in FIG. 1 with lap siding installed thereupon. As shown, three pieces of lap siding are at least partially shown and generally indicated at 14, 16 and 18. Each piece of lap siding includes a bottom edge, or downwardly oriented surface, 20 and a face 22. The faces 22 include an exposed portion 24 and an occluded portion 26, which is covered, or overlapped, by the piece of lap siding installed above it. It should be understood that the top-most piece of lap siding installed on face 10 may not have an occluded portion or that occluded portion 26 may be formed by a piece of molding or trim, as opposed to another piece of lap siding. The distance between adjacent edges 20 is referred to as the "reveal" or "reveal distance" 28 of the lap siding and corresponds to the generally vertical length of the exposed portions 24 of the pieces of lap siding. The dimensions of the reveal may vary, with four, five, six, seven and eight inch reveals being common. Typically, each piece of lap siding is at least four feet in length, and lap siding is often at least six, eight, ten, twelve or more feet in length. Lap siding may be formed of any suitable material, including wood, composites, metal, vinyl, and the like. It should be understood that the length, height, reveal and materials of construction of the lap siding may vary and that the scope of the present invention should not be limited to a particular range of values for these variables. Instead, a lap siding tool constructed according to the present invention may be sized to accommodate any particular type of lap siding.

Figure 2:
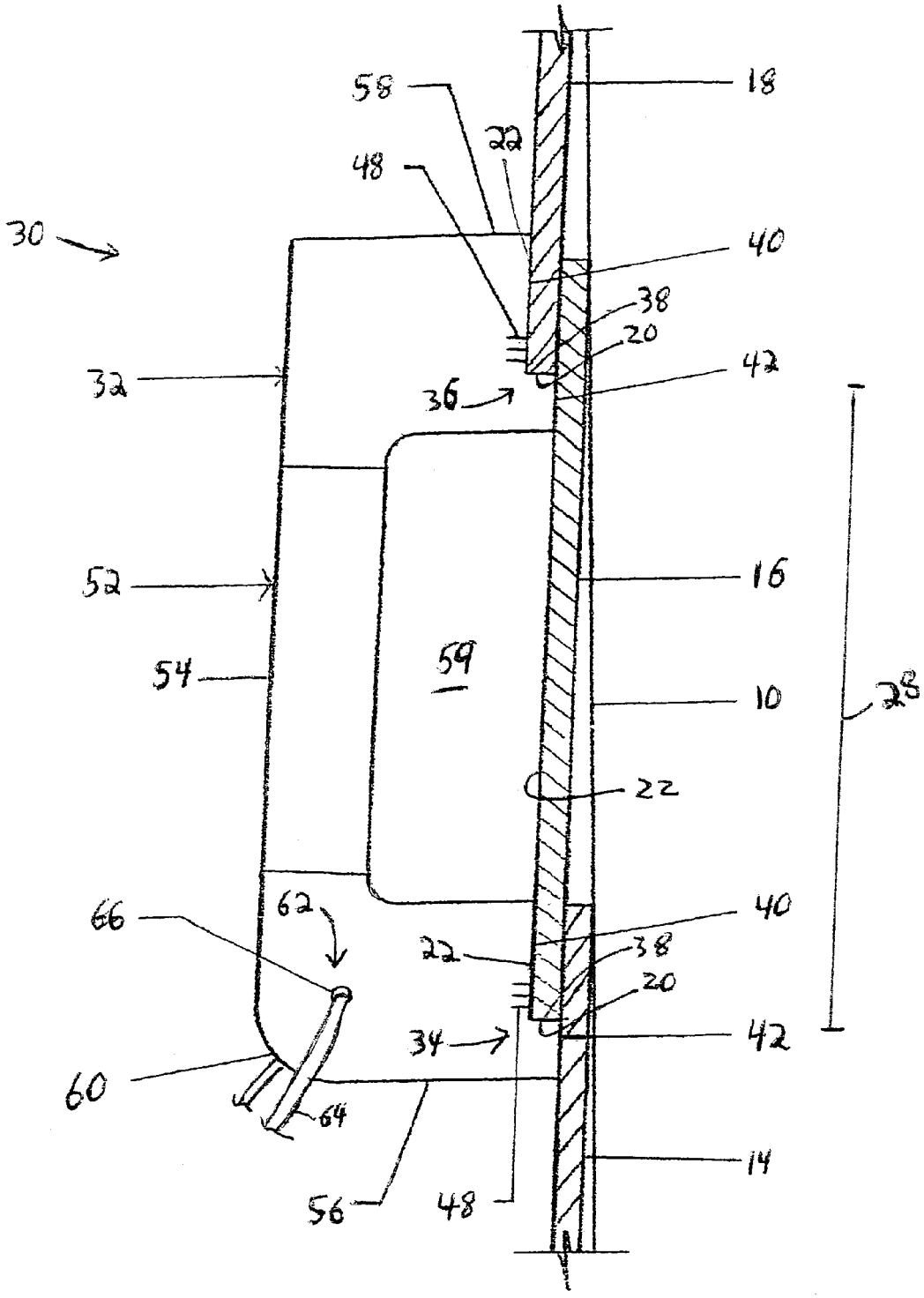
FIG. 2 is a side elevation view of an embodiment of a lap siding installation tool constructed according to the present invention and shown positioned and held during installation of a siding piece to the face of a building.

A lap siding installation tool constructed according to the present invention is shown in FIG. 2 and generally indicated at 30. Tool 30 includes a body 32 and a pair of vertically spaced-apart seat assemblies 34 and 36. Seat assemblies 34 and 36 are respectively adapted to engage a previously installed piece of lap siding and to support and position a piece of lap siding to be installed at a selected reveal distance relative to the previously installed piece of lap siding.

Body 32 may be formed of any suitable material having sufficient strength and durability to support the pieces of lap siding to be installed. Non-exclusive examples of suitable materials include metal, plastic, composites and combinations thereof. Body 32 may be a monolithic structure or may include a plurality of interconnected pieces, which may be formed of the same or different materials and which may have the same or different thicknesses. It should be understood that the height of body 32 will typically vary, at least to some degree, depending upon the reveal or range of reveals that a particular tool is designed to produce. The thickness of the body may vary, such as from approximately ⅛ or ¼ of an inch thick to an inch or more in thickness, depending largely upon user-preferences and the thickness required to provide sufficient support to the tool. Similarly, the thickness of the tool may vary along the length of the body.

As shown in FIG. 2, each seat assembly includes a seat 38 that is adapted to engage the bottom surface 20 of a piece of lap siding, and a flange 40 that is adapted to engage the face 22 of the piece of lap siding. For example, and as shown in FIG. 2, tool 30 is shown being used to position piece 18 of lap siding at a predetermined, or standard, reveal 28 relative to piece 16. In the illustrated embodiment, the seat assemblies further include supports 42 that extend beneath seat 38 and toward face 22 of the corresponding pieces of lap siding. In the illustrated embodiment, supports 42 have the approximately same length as the thickness of the lower portion of the corresponding pieces of lap siding. It is within the scope of the present invention that the length of supports 42 may be either longer or shorter than the thickness of the pieces of lap siding, although a shorter distance is preferred because it enables the pieces of lap siding to be urged against the corresponding underlying pieces of lap siding.

As used herein, the term "seat distance" is used to refer to the distance between seats 38 of the seat assemblies. It should be understood that this seat distance at least substantially defines the reveal distance between the previously installed piece of lap siding and the piece of lap siding to be installed. In some applications, such as shown in FIG. 2, the reveal distance and the seat distance are the same. However, and as discussed in more detail below, the tool may be used to select reveal distances that are larger or greater than the seat distance, such as through the use of the subsequently described gradations. The seat distance may also be described as the standard reveal of, or defined by, the tool.

In experiments, a seat assembly that includes a seat 38 that is approximately ¼ inch in length, a flange 40 that is approximately 1.25 or 1.5 inches in height, and a support 42 that is approximately ¾ of an inch in height has proven effective, but these dimensions are only one example of many possible values. For example, it may be desirable for the length of at least the seat 38 of the upper seat assembly to be at least slightly less than the thickness of the thinnest siding products available in the industry so that the flanges may be used to urge the pieces of lap siding may be firmly pressed against the corresponding underlying pieces of lap siding. For example, lap siding typically is at least 0.3125 inches thick, so at least seat 38 of seat assembly 36 is preferably less than this thickness if a particular embodiment of the tool is desired to be usable for any type of siding. Of course, greater lengths may be used, such as when the tool is designed for use with a larger thickness of lap siding, and are within the scope of the invention. In experiments, a height of at least 1.5 inches has proven effective for flange 40 of upper seat assembly 36, and a height of approximately 1.25 inches has proven effective for flange 40 of lower seat assembly 34. A dimension of 1.25 inches corresponds to a common overlap distance for lap siding, and therefore a flange having a height of 1.25 inches may be used to provide a guide or verification for the proper spacing of the lap siding.

As used herein, the term "piece of lap siding to be installed" refers to the piece of lap siding being positioned and supported by tool 30, and the term "previously installed piece of lap siding" refers to the piece of lap siding that provides the basis or reference position for tool 30 and over which the piece of lap siding to be installed partially overlaps. For example, in FIG. 2, piece 18 is the piece of lap siding to be installed and piece 16 is the previously installed piece of lap siding. Once installed, piece 18 will become the previously installed piece of lap siding for the next piece of lap siding installed thereabove.

In the embodiment shown in FIG. 2, seats 38 and flanges 40 are shaped to provide continuous surfaces of contact with the edges and faces of the corresponding pieces of siding. As shown, the seat assemblies may be described as being laterally offset from each other to account for the differences in generally vertical position between adjacent pieces of siding. It should be understood that it is within the scope of the present invention that either or both of seat 38 and flange 40 may provide discontinuous or spaced-apart regions or points of contact, instead of a continuous surface of contact. In the illustrated embodiment, the seats and flanges are integrally formed and extend at right angles to each other. However, it is within the scope of the present invention that the seats and flanges may be separately formed from the same or different materials, that the corresponding seat and flange of a particular seat assembly may be adjustable relative to each other, and that the seats and flanges may extend at angles other than 90° relative to each other.

As discussed in the background, a piece of lap siding occasionally needs to be installed intentionally with different reveals on each end of the piece of lap siding. For example, when the face of a building, or portion thereof is not square or otherwise has different heights at each end, the reveals of lap siding installed thereupon may be adjusted horizontally along the face to accommodate the dimensions of the face of the building. For example, if a face of building differs in height between its ends by three inches and single length pieces of lap siding are to be used to side that face, the reveals of each end of the pieces of lap siding may be adjusted so that over the course of the height of the face, the three-inch difference is made up. For example, the reveals may differ by an eighth, a quarter, or other portion or multiple of an inch to cumulatively make up this difference in height.

In the embodiment of the invented tool shown in FIG. 2, the tool includes gradations 48 to enable installers to accurately adjust the standard reveal, or seat distance, of tool 30. As shown, tool 30 includes gradations 48 associated with each seat assembly 34 and 36. It is within the scope of the invention, however, that the tool may include only a single set of gradations associated with either the top or bottom seat assembly, or that it may be formed without any gradations. Upper and lower sets of gradations 48 enable the height of the reveal produced by tool 30 to be increased or decreased from the standard reveal of the tool. Gradations 48 typically are spaced-apart from each other (and optionally from the seat 38 of the respective seat assembly), by a repeated increment, such as 1/16, 1/8, 1/4 or other fraction of an inch or other unit of measure. In FIG. 2, gradations 48 take the form of vertically spaced-apart marks. However, it is within the scope of the invention that gradations 48 may take any suitable form, including indicia, numbers, symbols and combinations thereof.

To illustrate one method of using gradations 48, consider a tool 30 having a standard, or predetermined, reveal of 7 inches. If in a particular application it is determined that the next few reveal sizes are to be larger, say 7.125 inches, in order to efficiently accommodate the bottom of a window opening, gradations 48 enable tool 30 to be used to accurately produce these adjusted reveals. For example, the piece of siding to be installed is initially placed into the tool as if the standard reveal was going to be used. However, before mechanically fastening the piece of lap siding to be installed, the piece is adjusted upward such that its bottom edge 20 aligns with a selected one of the gradations associated with upper seat assembly 36. The piece of siding to be installed may be retained in this orientation prior to being mechanically fastened to face 10 by applying pressure with flange 40 against face 22 of the piece of siding to be installed. In such a configuration, the seat distance is less than the reveal distance. Gradations 48 associated with lower seat assembly 34 may be employed in a similar fashion in the above example to create reveals smaller than the standard reveal. More specifically, after positioning the piece of siding to be installed and the tool for the standard reveal, the tool may be adjusted downward so that edge 20 of the previously installed piece of siding aligns with a selected one of the gradations. As tool 30 is adjusted downward, the piece of siding to be installed should be allowed to move with the tool and thereby also be adjusted downward. In such a configuration, the seat distance is greater than the reveal distance.

In the illustrated embodiment, seat assemblies 34 and 36 respectively engage both the bottom edges and faces of the piece of lap siding to be installed and the previously installed piece of lap siding. In this configuration, tool 30 not only controls the vertical spacing between the pieces of lap siding, but also urges the piece of lap siding to be installed against the previously installed piece of lap siding. Accordingly, flanges 40 provide a generally horizontal stabilizing, or supporting, force upon the pieces of lap siding during installation. For example, this force may be used to ensure that the lower portion of the face of the piece of lap siding to be installed is flush against the corresponding occluded portion 26 of the previously installed piece of lap siding.

Figure 3:
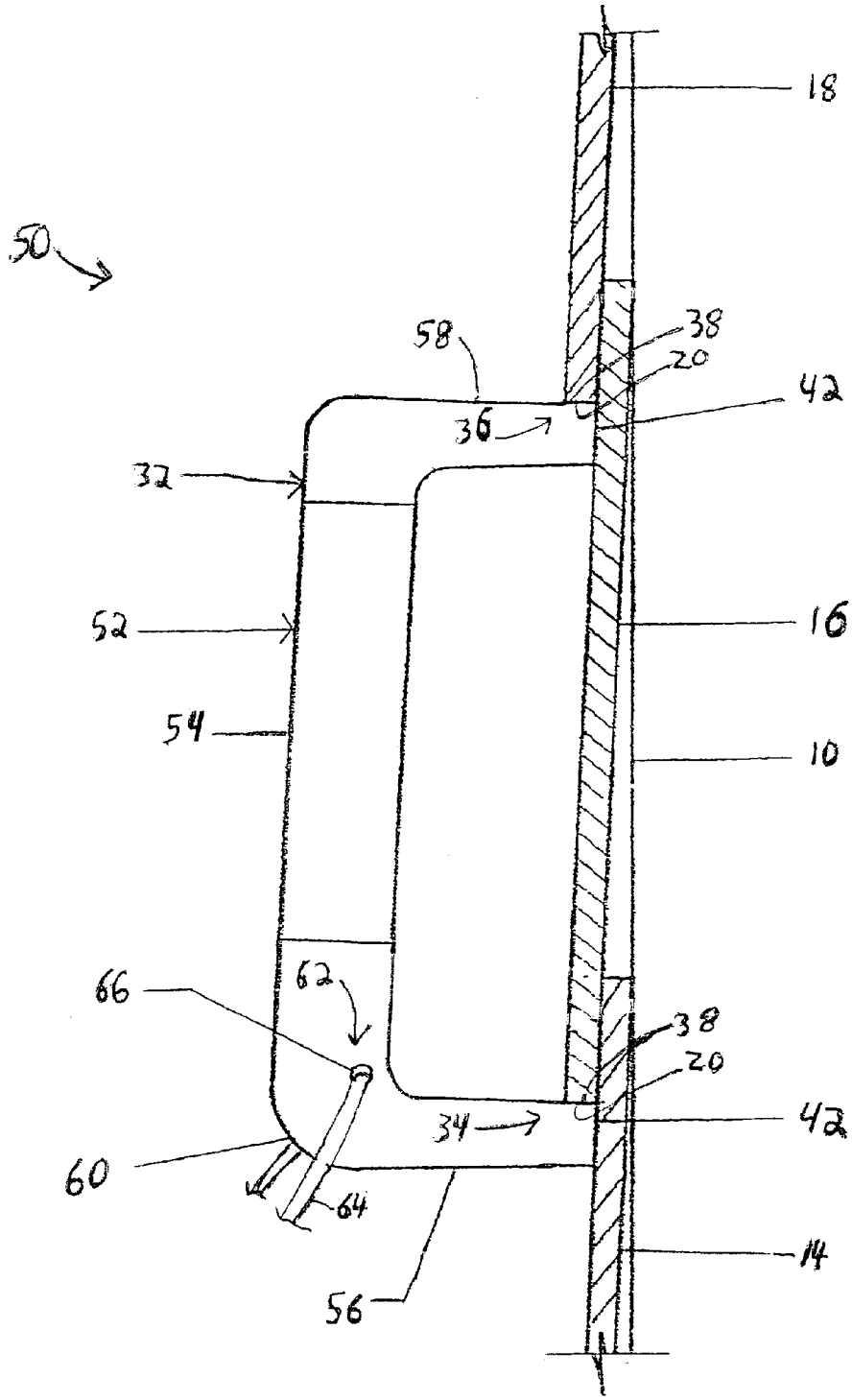
FIG. 3 is a side elevation view of another embodiment of a lap siding installation tool constructed according to the present invention.

It is within the scope of the present invention that either or both of the seat assemblies may be formed without a flange 40. An example of such an embodiment is shown in FIG. 3 and generally indicated at 50. In the illustrated embodiment, both seat assemblies are shown without a flange 40. Accordingly, the seat assemblies in tool 50 cooperate to support and position the piece of lap siding to be installed at a predetermined reveal relative to the previously installed piece of lap siding, but does not provide a force that urges the pieces of lap siding against each other. As a further variation, one of the seat assemblies, such as assembly 36, may be formed with a flange 40 and one of the seat assemblies, such as assembly 34, may be formed without a flange 40.

Tools 30 and 50 further include a handle 52 that is adapted to be gripped by a user, such as with one of the user's hands. Handle 52 may be integrally formed with the tool's body. Additionally or alternatively, at least a portion of the handle may be mounted on the body. For example, the handle may include a grip structure 54 that is wrapped, adhered or otherwise secured to a portion of the body. Grip structure 54 may be formed of any suitable grip-enhancing material, such as rubber, plastic, metal or other materials that provide a more comfortable surface for gripping and/or promote a film grasp by a user's hand. Preferably, handle 52 is sized for comfortable gripping by a user's hand, with sufficient tolerance to accommodate a hand wearing work gloves. A handle that is approximately one-inch in thickness has proven effective, but the dimensions of the handle may vary. Handle 52 may have a uniform cross-section or may vary in thickness to form a comfortable shape for gripping. Similarly, the handle may have a thickness that is greater or less than the thickness of the rest of the tool.

In the illustrated embodiments of FIGS. 2 and 3, the tool has a generally C-shaped configuration, with body 32 including arms 56 and 58 interconnecting handle 52 with seat assemblies 34 and 36. Furthermore, a portion 60 of the tool provides a head upon which a generally upward force may be imparted to ensure that the tool firmly engages the previously installed piece of siding to accurately position the seat of the upper seat assembly relative to the previously installed piece of siding. In some embodiments, portion 60 may be referred to as a "palm point," in that the force may be applied by the palm of a user's hand. Also shown in FIG. 2 is an optional retainer 62 that enables tool 30 to be coupled to a user's body, clothing, or adjacent structures, such as scaffolding, when not being used to position lap siding. Any suitable structure may be used. In the illustrated embodiment, retainer 62 takes the form of a tether 64 that passes through an aperture 66 in the tool. Illustrative and non-exclusive examples of other suitable retainers 62 include a clip and a magnet.

It is within the scope of the present invention that the lap siding installation tools shown and described herein may have other shapes and geometries so long as the operative structure described herein is provided. For example, it is not required that the tool have a generally C-shaped configuration, with arms 56 and 58 and handle 52 defining an open region 59 between the tool and the face of the previously installed piece of lap siding. Similarly, handle 52 may extend from the body, may include an aperture within the body, may extend at least partially above seat assembly 36 or below seat assembly 34, or may be oriented generally transverse to the faces of the pieces of lap siding. An advantage of the handle configuration shown in FIGS. 2 and 3 is that the user may grip the handle with one hand and apply generally equal amounts of force to both seat assemblies.

Figure 4:
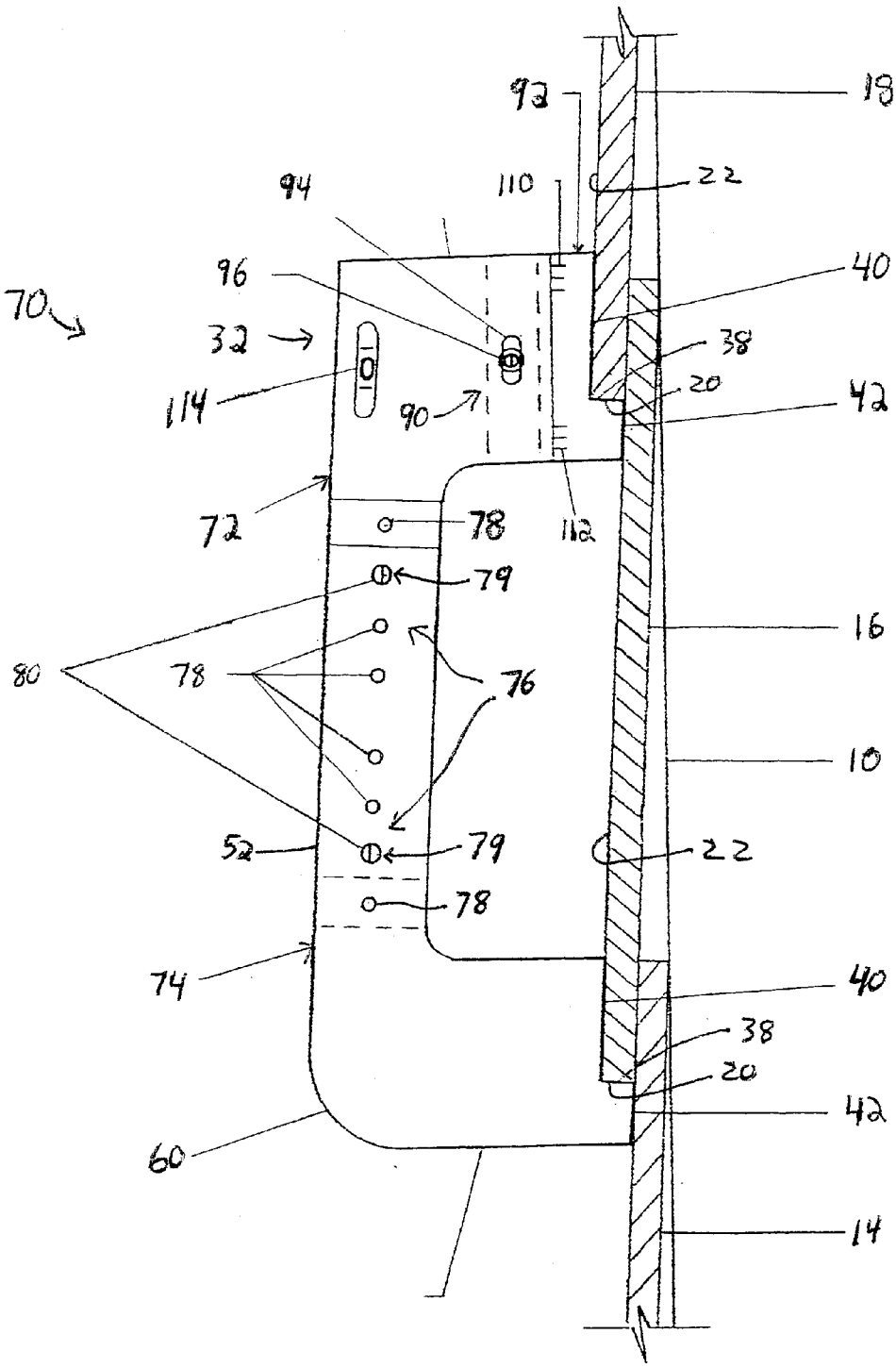
FIG. 4 is a side elevation view of another embodiment of a lap siding installation tool according to the present invention.

Another lap siding installation tool constructed according to the present invention is shown in FIG. 4 and generally indicated at 70. Unless otherwise set forth herein, it should be understood that tool 70 may have the same elements, subelements, and variations as the other embodiments illustrated and described herein. In tool 70, the height of body 32 is adjustable, thereby enabling the standard reveal, or seat distance, defined between seats 38 to be adjusted. Accordingly, tool 70 may be described as including a height-adjustment mechanism 76, or as having an adjustable reveal. In the illustrated embodiment, body 32 include members 72 and 74 that may be selectively positioned and secured relative to each other to define a selected seat distance. The inclusion of a height-adjustment mechanism enables the seat distance, and thereby the reveal, to be selectively adjusted between a range of positions, which include a maximum and a minimum position. For example, the height adjustment mechanism may enable the height of the seat and reveal distances to be adjusted by a total of one, two, three, four, or more inches, with the possible positions within this range being either continuous within this range or incremental within the range.

Height-adjustment mechanism 76 is further adapted to selectively and releasably secure members 72 and 74 in a selected position within the range of possible positions. Height-adjustment mechanism 76 may include any suitable structure that may perform this function. An example of a suitable mechanism is shown in FIG. 4 in the form of a plurality of spaced-apart apertures 78 that extend through members 72 and 74 and fasteners 79 that are used to retain the members in a selected orientation defined by aligned apertures in members 72 and 74. Accordingly, the apertures may be described as establishing predetermined or predefined positions of the members. Fasteners 79 may engage apertures 78 by any suitable mechanism. For example, apertures 78 may be threaded to engage a threaded fastener, such as a bolt 80. Additionally, or alternatively, fastener 79 may take the form of a nut-and-bolt assembly, in which case the fastening mechanism includes nuts 82 (shown in FIG. 5) that receive bolts 80 to secure the members in the selected orientation. Apertures that are approximately 3/16 inch in diameter and spaced along the center of the body axis have proven effective, but any suitable sizing, placement and number of apertures may be used and are within the scope of the present invention. Non-exclusive examples of other suitable fastening mechanisms include releasable ratchet mechanisms, releasable pins, and cams that releasably compress the members together to secure the members in a selected orientation.

Figure 5:
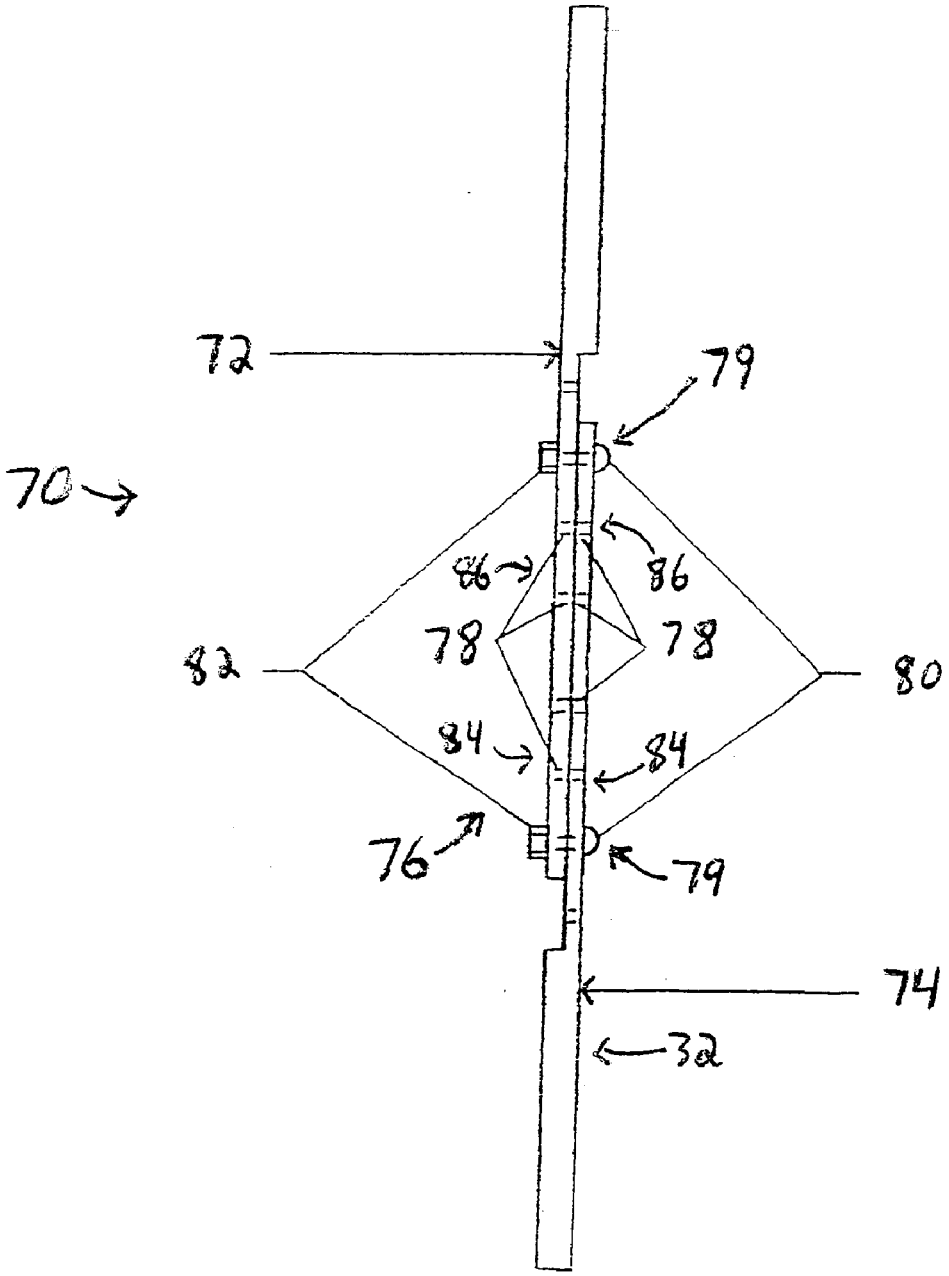
FIG. 5 is a rear elevation view of the tool of FIG. 4.

In the illustrated embodiment, and perhaps best seen in FIG. 5, each member 72 and 74 includes two sets 84 and 86 of apertures 78 that collectively define a single range of incremental positions. Also shown in FIG. 5 are a pair of bolts 80 and corresponding nuts 82 that are used to secure the members in a selected position. The use of two or more sets of apertures and corresponding bolt-and-nut assemblies provides additional support to the tool compared to a single height-adjustment mechanism. In the particular embodiment shown in FIG. 5, members 72 and 74 have been adjusted one incremental notch from the minimum position within the range of predetermined positions, and include two additional incremental increases in length. Similarly, if the bolt-and-nut assembly or assemblies are passed through only a single set of the apertures, then an additional three predetermined positions are possible. It is within the scope of the invention that each member may include only a single set of apertures, through which one or more bolt-and-nut assemblies are passed. The illustrated embodiment of height-adjustment mechanism 76 may be referred to as an incremental height-adjustment mechanism, in that the relative position of members 72 and 74 is selectively adjusted by predetermined increments within a range of positions.

Figure 6:
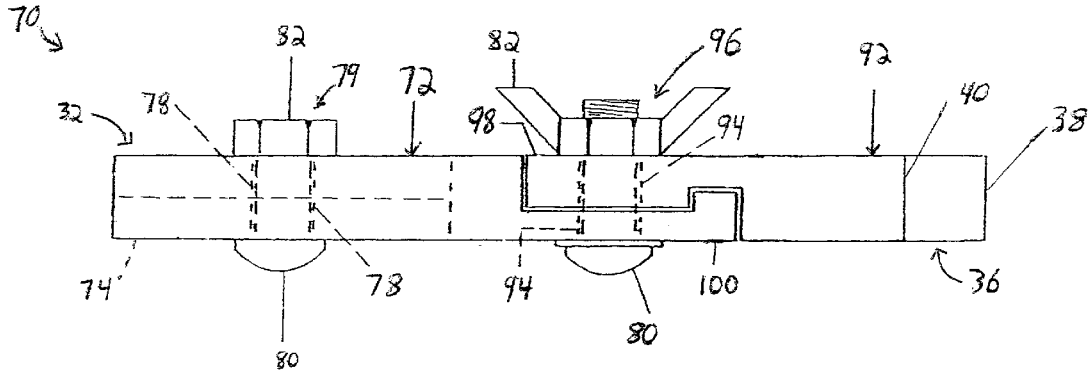
FIG. 6 is a top plan view of the tool of FIG. 4.

In the illustrated embodiment, tool 70 further includes another embodiment of a height-adjustment mechanism, namely a continuous, or slidable, height-adjustment mechanism, which is generally indicated at 90. Mechanism 90 enables the size of the reveal defined by tool 70 to be adjusted within a continuous range of positions. By "continuous," it is meant that the members may be selectively retained anywhere within a range of positions within maximum and minimum positions, as opposed to the previously discussed incremental mechanism in which only predetermined positions between the maximum and minimum positions may be selected. In the illustrated embodiment, body 32 includes members 72 and 92 that are slidably positionable relative to each other. Each member includes an elongate slot 94 that extends generally parallel to the face of the piece of lap siding to be installed. Mechanism 90 further includes a fastener 96, such as a bolt-and-nut assembly, cam assembly or the like, that extends through the slots and is tightened to releasably secure the members in a selected position. For example and as shown in FIG. 6, members 72 and 92 include overlapping portions 98 and 100 that each include slots 94. Fastener 96 includes a nut-and-bolt assembly (including a bolt 80 and a nut 82) that is used to selectively compress and frictionally retain members 72 and 92 together in a selected position defined at least in part by the length of slots 94.

Figure 7:
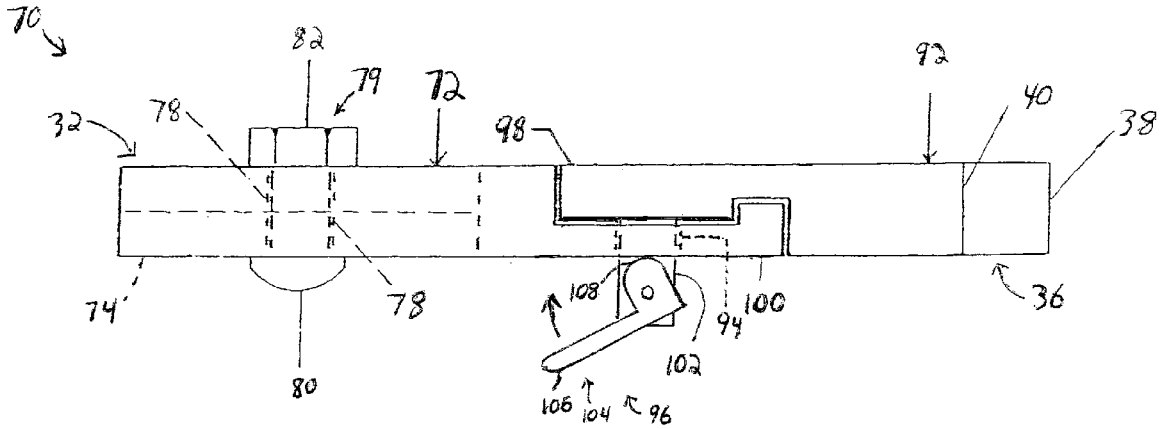
FIG. 7 is a top plan view of a variation of the embodiment of the tool shown in FIG. 6.

In a variation of the fastener shown in FIG. 6, one of members 72 and 92 may include slot 94, with the member including a guide 102, such as a projection, pin, threaded member or the like, that extends through the slot and is engaged by a suitable fastener to selectively retain the members in a selected orientation. To further illustrate that fastener 96 and fasteners 79 may have a variety of suitable forms, fastener 96 is shown in FIG. 7 as including a cam assembly 104 with a lever arm 106 and cam mechanism 108 that selectively retain members 72 and 92 in a selected orientation relative to each other. As shown, pivoting lever arm 106 toward body 32, such as indicated with an arrow in FIG. 7, causes cam mechanism 108 to engage portion 100 and urge portions 98 and 100 together. It should be understood that either of members 72 and 92 could include slot 94, with the other including the corresponding guide 102.

Additionally, or alternatively, to the gradations 48 discussed above, a lap siding installation tool that includes a height-adjustment mechanism according to the present invention may, but does not necessarily, include gradations associated with the height-adjustment mechanism. For example, tool 70 may include gradations associated with the predetermined incremental positions to indicate the height of the reveal when members 72 and 74 are in a particular relative position with respect to each other. Similarly, in an embodiment of the tool that includes a continuous height-adjustment mechanism, such as mechanism 90, the tool may include gradations along the range of positions so that a user may more easily configure the tool repeatably to a selected reveal height. An example of such an embodiment is shown in FIG. 4 in which slide adjustment mechanism 90 includes upper and lower sets 110 and 112 of gradations that may be used respectively to increase or decrease the height of the reveal. In the illustrated embodiment, the gradations take the form of vertically spaced-apart marks on member 92. Aligning a particular mark with the respective upper or lower edge of portion 100 enables the height of the reveal to be adjusted accordingly. It should be understood that only a single set of gradations may be used, that the gradations could alternatively be on member 72, that each set may include as few as one or more than the three gradations shown in FIG. 4, and/or that a single set of gradations that spans the distance between the upper and lower edges of portions 98 and 100 may be used. Similarly and as discussed with respect to gradations 48, the gradations may take any suitable form, including numbers, symbols and the like.

It should be further understood that an incremental height-adjustment mechanism according to the present invention may similarly include a fastener that includes a cam assembly 104. Similarly, the incremental height-adjustment mechanism may be at least partially integrally molded with the body of the device. For example, one of the members may include molded apertures, with the other including at least one projection that extends from the other member as an integral component thereof and which is adapted to be selectively passed through the apertures to select the relative position of the members with respect to each other.

It should be understood that tool 70 provides an illustrative example of height-adjustment mechanisms that provide incremental and continuous range of positions. It is within the scope of the present invention that the lap siding installation tool may be formed with either or both of these height-adjustment mechanisms. For example, an incremental adjustment mechanism, such as mechanism 76, may be used to select from a predetermined incremental range of positions, while a continuous adjustment mechanism, such as mechanism 90, may be used to enable fine adjustment within a continuous range of positions bounded by adjacent incremental ranges of position. Similarly, a continuous adjustment mechanism may be used in place of the range of apertures 78 to provide a larger continuous range of positions.

Referring again to FIG. 4, tool 70 is shown further including a level 114. As shown, level 114 takes the form of a bubble level, but any suitable mechanism for indicating the horizontal and/or vertical orientation of the tool may be used. Similarly, the tool may include more than one level to enable both horizontal and vertical orientations to be verified without moving or reorienting the tool. It is within the scope of the present invention that any of the embodiments of the lap siding installation tool may be formed with or without a level.

Figure 8:
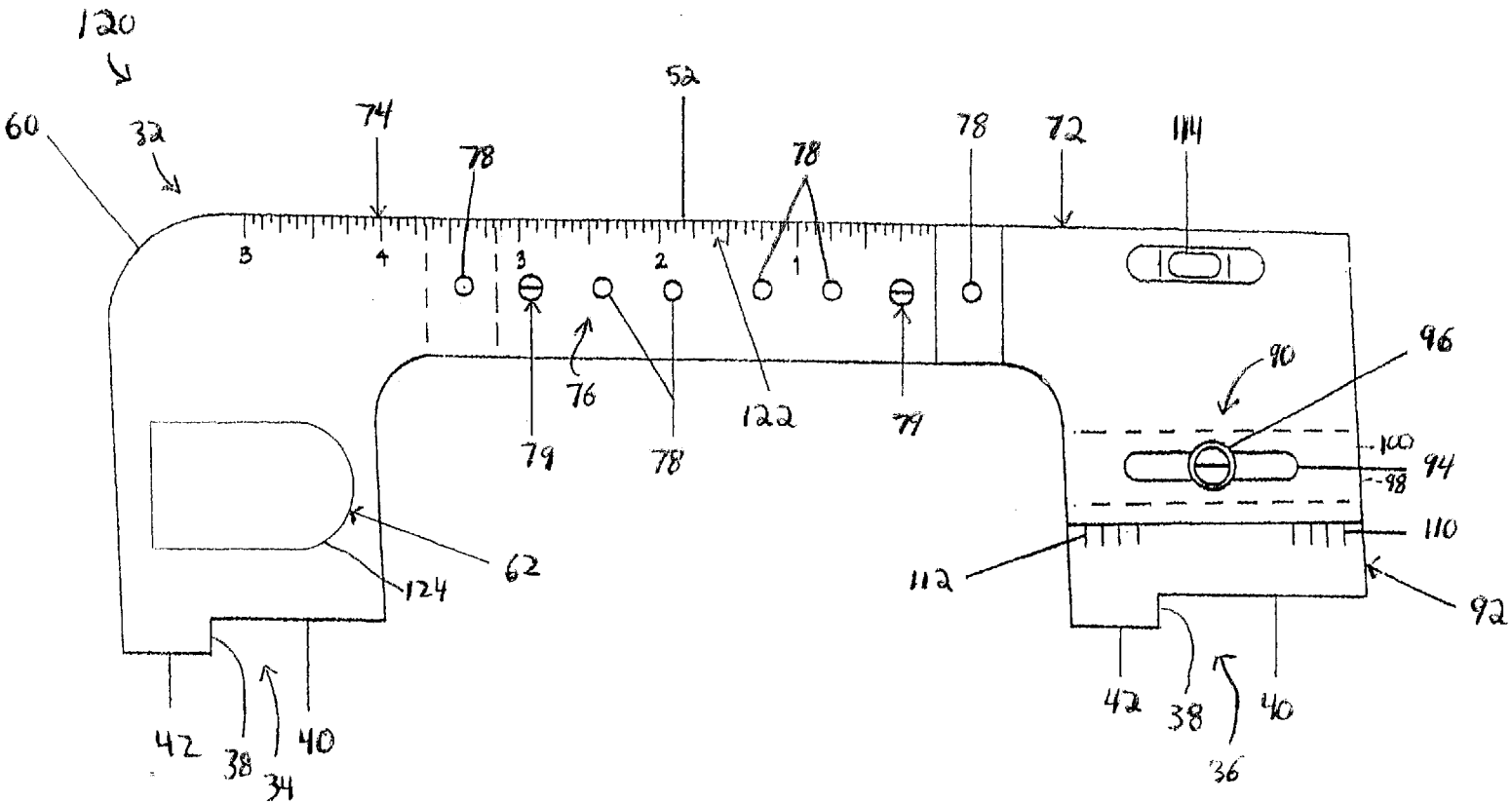
FIG. 8 is a side elevation view of another embodiment of a lap siding installation tool according to the present invention.
Figure 9:
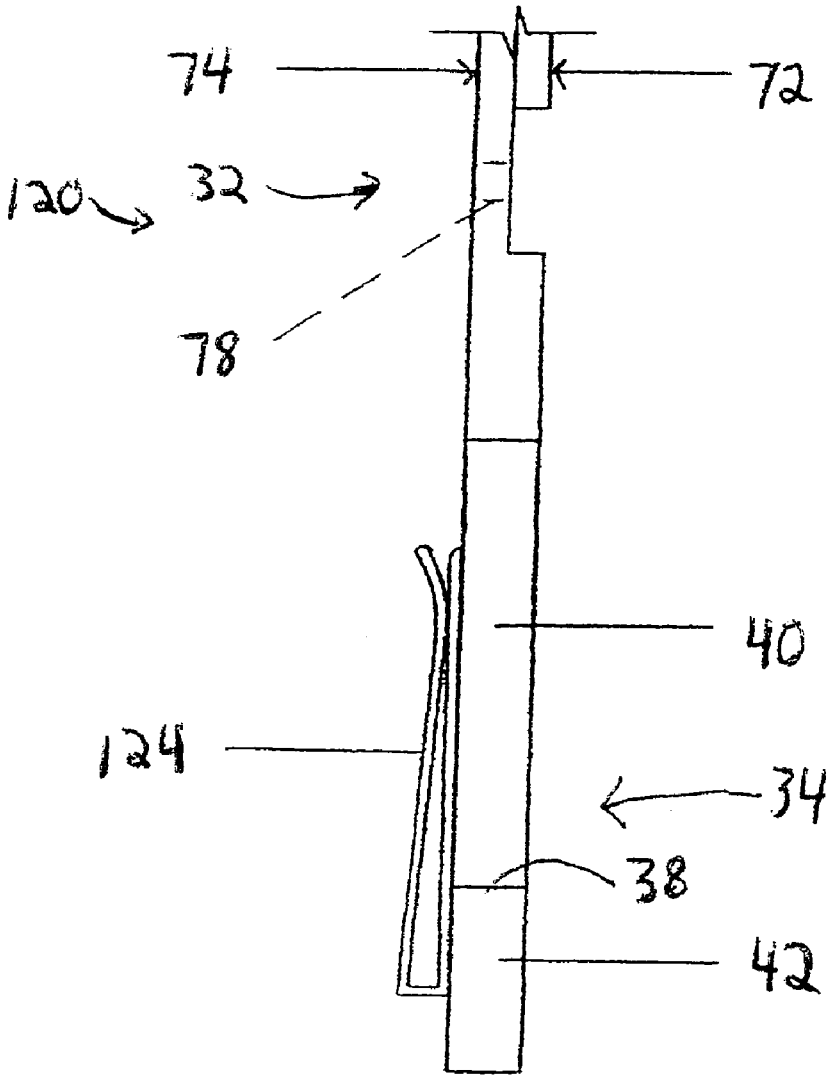
FIG. 9 is a fragmentary front elevation view of the tool shown in FIG. 8.

Another embodiment of a lap siding installation tool according to the present invention is shown in FIG. 8 and generally indicated at 120. It should be understood that tool 120 may include any of the elements, subelements and variations discussed herein. Similarly, it should also be understood that tool 30 may include any of the elements, subelements and variations described and/or illustrated with respect to tools 70 and 120. As shown, tool 120 further includes a scale 122 extending along at least a portion of body 32. In the illustrated embodiment, scale 122 is measuring in 1/16-inch inch increments. It should be understood that scale 122 may be formed in other selected increments or units of measure, such as centimeters. Scale 122 may be formed on or attached to the tool via any suitable mechanism, such as engraving, molding, adhesive, embossment, etc. Tool 120 also illustrates another example of a suitable retainer 62, namely, a clip 124, which is shown in FIGS. 8 and 9.

Field testing and application of a specific embodiment of the present invention.

From a sheet of plastic, two tools were cut to a configuration similar to the embodiment disclosed in FIG. 2 and described herein. Said tools were privately employed to install about 2000 square feet of lap siding. During installation, a siding piece to be installed was lifted and temporarily positioned above a previously installed siding piece by two installers, one at each end of the siding piece and using one hand. Henceforth, the tool was gripped about handle 52 with the other hand and seat 38 of upper seat assembly 36 was placed under the bottom edge of the siding piece to be installed, whereby the tool was pushed upward and toward building face 10 until seat 38 of lower seat assembly 34 came into contact with the bottom of the previously installed siding piece and held firmly in place. The hand previously used to lift and hold the siding piece to be installed was then released and employed to mechanically fasten the siding piece to be installed in the position and with the reveal defined by the tool. The tool was then released by simply withdrawing the tool from engagement with the siding piece to be installed, such as by lowering the tool or moving the tool away from face 10. The newly installed piece of lap siding now becomes the previously installed siding piece relative to the next piece of siding to be installed. The next consecutive siding piece was then quickly lifted and placed and the above procedure repeated. At regular intervals during the installation of the 2000 square feet of siding, the accuracy of the invention was checked by taping measurements at both ends of the building to previously marked level lines made for such purpose. These checks showed the invention provided accurate and consistent reveals throughout the installation.

It should be understood that the above example is but one method of using the lap siding installation tools according to the present invention, and that it is within the scope of the invention that other methods may be used, such as a method in which the tool is firmly engaged against the bottom edge of the previously installed siding piece before the siding piece to be installed is engaged with the tool.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A tool to assist a user in positioning and supporting a piece of lap siding to be installed at a reveal distance from a previously installed piece of lap siding, comprising:

a body including a handle adapted to be grasped by the user, a lower seat assembly and an upper seat assembly, wherein the lower seat assembly includes a lower seat adapted to contact a bottom edge of the previously installed piece of lap siding, wherein the upper seat assembly includes an upper seat adapted to support a bottom edge of the piece of lap siding to be installed, wherein the upper seat assembly further includes a flange adapted to engage, without piercing, a face of the piece of lap siding to be installed to position the piece of lap siding to be installed against the previously installed piece of lap siding, wherein the upper seat and the lower seat are spaced apart by a seat distance that defines at least substantially the reveal distance, which is measured between the bottom edges of the previously installed piece of lap siding and the piece of lap siding to be installed; and further wherein the upper seat assembly includes gradations defining incremental adjustments adapted to increase the reveal distance without increasing the seat distance.

2. The tool of claim 1, wherein the seat distance and the reveal distance are equal.

3. The tool of claim 1, wherein the upper seat assembly further includes a support extending beneath the upper seat and adapted to extend toward a face of the previously installed piece of lap siding and to contact, without piercing, the face of the previously installed piece of lap siding.

4. The tool of claim 1, wherein the lower seat assembly further includes a flange adapted to contact, without piercing, a face of the previously installed piece of lap siding.

5. The tool of claim 1, wherein the handle, the upper seat assembly and the lower seat assembly form a monolithic structure.

6. The tool of claim 5, wherein the body is generally C-shaped.

7. The tool of claim 6, wherein the body further includes upper and lower arms that respectively extend from the upper and the lower seat assemblies generally toward the handle to space the handle away from the seat assemblies and the piece of lap siding to be installed, wherein the body is adapted to define an open passage between the handle and the piece of lap siding to be installed, with the passage being sized to receive a user's fingers therethrough when the handle is grasped within a user's hand and the tool is used to position the piece of lap siding to be installed.

8. The tool of claim 1, wherein the lower seat assembly includes gradations defining incremental adjustments to decrease the reveal distance while leaving the seat distance unchanged.

9. The tool of claim 1, wherein the handle is positioned generally between the upper and the lower seat assemblies.

10. The tool of claim 1, further including a retainer that is independent of the upper and the lower seat assemblies and is adapted to retain the tool in a selected location.

11. The tool of claim 1, wherein the body further includes a level.

12. The tool of claim 1, wherein the tool includes a height adjustment mechanism adapted to adjust the seat distance within a range of positions.

13. The tool of claim 12, wherein the range of positions includes a maximum position, a minimum position and a continuous range of positions between the maximum position and the minimum position.

14. The tool of claim 12, wherein the range of positions includes a maximum position, a minimum position and at least one predefined position generally between the maximum position and the minimum position.

15. The tool of claim 14, wherein the range of positions includes a plurality of predefined positions between the maximum position and the minimum position.

16. The tool of claim 15, wherein the plurality of predefined positions are incrementally spaced between the maximum position and the minimum position.

17. The tool of claim 12, wherein the body includes a plurality of members, with the upper seat assembly adapted to move with one of the plurality of members and the lower seat assembly adapted to move with another one of the plurality of members, wherein the plurality of members are adapted to be selectively and adjustably positioned with respect to each other, and further wherein the height adjustment mechanism is adapted to releasably secure the plurality of members in a selected position with respect to each other to define the selected seat distance.

18. The tool of claim 17, wherein at least one of the members includes a plurality of apertures through which a fastener may be selectively inserted to retain the plurality of members in a selected position with respect to each other.

19. The tool of claim 18, wherein at least two of the plurality of members each include a plurality of apertures, and further wherein the height adjustment mechanism includes at least one fasteners adapted to be selectively passed through aligned apertures in the at least two of the plurality of members to selectively secure the plurality of members in a selected position with respect to each other.

20. The tool of claim 17, wherein at least one of the plurality of members includes an elongate slot that defines the range of positions.

21. The tool of claim 20, wherein at least one of the plurality of members includes a guide adapted to travel within the slot as the members are moved with respect to each other.

22. The tool of claim 1, wherein at least a portion of the flange of the upper seat assembly is adapted to extend along the face of the piece of lap siding to be installed.

23. The tool of claim 1, wherein at least a substantial portion of the flange of the upper seat assembly is adapted to extend in contact with and generally parallel to the face of the piece of lap siding to be installed.

24. The tool of claim 1, wherein the flange of the upper seat assembly is adapted to engage a portion of the face of the piece of lap siding to be installed that is spaced apart from the bottom edge of the piece of lap siding to be installed.

25. The tool of claim 1, wherein the flange of the upper seat assembly extends at an angle, relative to the upper seat, that does not exceed 90°.

* * * * *